US006260635B1

(12) United States Patent
Crawford

(10) Patent No.: US 6,260,635 B1
(45) Date of Patent: Jul. 17, 2001

(54) ROTARY CONE DRILL BIT WITH ENHANCED JOURNAL BUSHING

(75) Inventor: Micheal B. Crawford, Duncanville, TX (US)

(73) Assignee: Dresser Industries, Inc., Dallas, TX (US)

( * ) Notice: Subject to any disclaimer, the term of this patent is extended or adjusted under 35 U.S.C. 154(b) by 0 days.

(21) Appl. No.: 09/237,133

(22) Filed: Jan. 25, 1999

Related U.S. Application Data

(60) Provisional application No. 60/072,566, filed on Jan. 26, 1998.

(51) Int. Cl.[7] ..... E21B 10/22

(52) U.S. Cl. ..... 175/371; 384/95

(58) Field of Search ..... 384/92, 94, 95, 384/96; 175/371, 372

(56) References Cited

U.S. PATENT DOCUMENTS

| | | | | |
|---|---|---|---|---|
| 1,779,487 | | 10/1930 | Childs . | |
| 2,214,221 | | 9/1940 | Catland | 308/198 |
| 2,283,312 | | 5/1942 | Boice . | |
| 2,339,161 | | 1/1944 | Femier | 308/9 |
| 3,449,024 | | 6/1969 | Lichte . | |
| 3,476,446 | | 11/1969 | Neilson | 308/8.2 |
| 3,823,030 | | 7/1974 | Hudson . | |
| 3,866,987 | * | 2/1975 | Estes | 308/8.2 |
| 3,917,361 | * | 11/1975 | Murdoch | 308/8.2 |
| 3,952,815 | | 4/1976 | Dysart | 175/374 |
| 4,054,772 | | 10/1977 | Lichte | 219/121 |
| 4,056,153 | | 11/1977 | Miglierini | 175/376 |
| 4,120,543 | | 10/1978 | Greene, Jr. et al. | 308/233 |
| 4,193,464 | | 3/1980 | Dixon . | |
| 4,194,794 | | 3/1980 | Kling | 308/3.8 |
| 4,235,480 | | 11/1980 | Olschewski et al. . | |
| 4,280,571 | | 7/1981 | Fuller | 175/337 |
| 4,304,444 | | 12/1981 | Persson | 308/8.2 |
| 4,730,681 | * | 3/1988 | Estes | 175/39 |
| 4,874,047 | | 10/1989 | Hixon . | |
| 4,955,440 | | 9/1990 | Chavez . | |
| 5,362,073 | | 11/1994 | Upton et al. . | |
| 5,439,068 | | 8/1995 | Huffstutler et al. | 175/356 |
| 5,456,327 | * | 10/1995 | Denton | 175/371 |
| 5,513,713 | | 5/1996 | Groves . | |
| 5,513,715 | | 5/1996 | Dysart | 175/371 |
| 5,547,033 | | 8/1996 | Campos, Jr. . | |
| 5,553,681 | | 9/1996 | Huffstutler et al. . | |
| 5,570,750 | | 11/1996 | Williams . | |
| 5,593,231 | | 1/1997 | Ippolito . | |
| 5,642,942 | | 7/1997 | Wagoner | 384/95 |
| 5,695,019 | | 12/1997 | Shamburger, Jr. . | |
| 5,709,278 | | 1/1998 | Crawford . | |
| B1 5,439,067 | | 3/1997 | Huffstutler | 175/339 |

FOREIGN PATENT DOCUMENTS 1406330 6/1988 (SU) .

OTHER PUBLICATIONS

"Roller Bits," Sandvik Coromant Rock Drilling Tools User's Handbook, *Sandvik Rock Tools*, HR–12820–ENG, 1994.

"Baker Hughes Mining Tools Product Catalog," *Baker Hughes Mining Tools* © 1991.

* cited by examiner

*Primary Examiner*—David Bagnell
*Assistant Examiner*—Zakiya Walker
(74) *Attorney, Agent, or Firm*—Groover & Associates; Robert Groover; Betty Formby

(57) ABSTRACT

The present invention allows the load carrying capability of a drill bit journal bearing or bushing to be increased. The present invention increases the length of the journal bushing by using the ball bearings to retain the journal bushing at a desired location between the journal and the cutter cone assembly. Normally, the journal bushing is retained by a flange formed on the interior surface of the cutter cone assembly. In the present invention, this flange is removed, and the ball bearings are used as a retention device for the journal bushing. With the flange removed, the length of the journal bushing may be increased.

10 Claims, 4 Drawing Sheets

ROTARY CONE DRILL BIT WITH ENHANCED JOURNAL BUSHING

RELATED APPLICATIONS

This application claims the benefit of previously filed provisional application U.S. Ser. No. 60/072,566, filed Jan. 26, 1998, entitled *Rotary Cone Drill Bit with Enhanced Journal Bushing.*

This application is related to co-pending application U.S. Ser. No. 09/237,172, filed Jan. 25, 1999, entitled *Rotary Cone Drill Bit with Enhanced Thrust Bearing Flange.*

TECHNICAL FIELD OF THE INVENTION

The present invention relates generally to rotary cone drill bits and more specifically to a rotary cone drill bit with an enhanced journal bushing.

BACKGROUND OF THE INVENTION

Various types of rotary drill bits or rock bits may be used to form a borehole in the earth. Examples of such rock bits include roller cone bits or rotary cone bits used in drilling oil and gas wells. A typical roller cone bit comprises a bit body with an upper portion adapted for connection to a drill string. A plurality of support arms, typically three, depend from the lower portion of the bit body with each support arm having a spindle or journal protruding radially inward and downward with respect to a projected rotational axis of the bit body.

A cutter cone assembly is generally mounted on each spindle or journal. Each cutter cone typically has a opening at its base, and a cavity extending from the base almost to the tip of the cutter cone. The cavity is formed such that it conforms with the associated journal. The cutter cone is supported rotatably on bearings acting between the exterior of the journal and the interior of the cutter cone assembly. The bearings in a typical rotary cone drill bit are heavily loaded during downhole drilling operations. In such drilling operations, the drill bit is rotated in a borehole, which causes the associate cutter cone assemblies to rotate on their respective journals. The drill bit typically operates at a low speed with heavy weight applied to the bit. This produces a high load on the associated bearings.

The journal typically includes a thrust flange. The top of the thrust flange typically bears the load applied to the journal that is generally parallel to the axis of the journal about which the cutter cone rotates. Such forces are applied to the journal by the cutter cone assembly, and to the cutter cone assembly by the borehole wall. A thrust washer or bushing may be placed between the thrust flange and the cutter cone assembly to help bear this load. In addition, the thrust flange may also be used to contain the ball bearings. In such a situation, the thrust flange also must bear the load applied by the ball bearings when forces are acting to pull the cutter cone assembly off of its respective journal.

Drill bits also typically include a journal bushing. The journal bushing is positioned around the journal, and between the journal and the cutter cone assembly. The journal bushing is used to bear some of the forces transmitted between the journal and the cutter cone assembly, and to facilitate the rotation of the cutter cone assembly about the journal.

SUMMARY OF THE INVENTION

In accordance with teachings of the present invention, a roller cone drill bit having support arms with a spindle or journal extending from each support arm, and a respective cutter cone assembly rotatably mounted thereon is provided with an improved journal bearing.

The present invention allows the load carrying capability of a drill bit journal bearing or bushing to be increased. The present invention teaches increasing the length of the journal bushing by using the ball bearings to retain the journal bushing at a desired location between the journal and the cutter cone assembly. Normally, the journal bushing is retained by a flange formed on the interior surface of the cutter cone assembly. In the present invention, this flange is removed, and the ball bearings are used as a retention device for the journal bushing. With the flange removed, the length of the journal bushing may be increased.

Technical advantages of the present invention include an increase in the load carrying capabilities of the journal bushing and the drill bit bearing system due to the increase in the length of the journal bushing. In addition, the use of a lengthened journal bushing increases the stability of the cutter cone assembly on the journal. This increased stability results in an increased useful life of the drill bit.

Other technical advantages will be readily apparent to one skilled in the art from the following figures, descriptions, and claims.

BRIEF DESCRIPTION OF THE DRAWINGS

For a more complete understanding of the present invention and its advantages, reference is now made to the following brief description, taken in conjunction with the accompanying drawings and detailed description, wherein like reference numerals represent like parts, in which.

DETAILED DESCRIPTION OF THE INVENTION

The preferred embodiments of the present invention and its advantages are best understood by referring now in more detail to FIGS. 1–9 of the drawings, in which like numerals refer to like parts.

Figure 1:
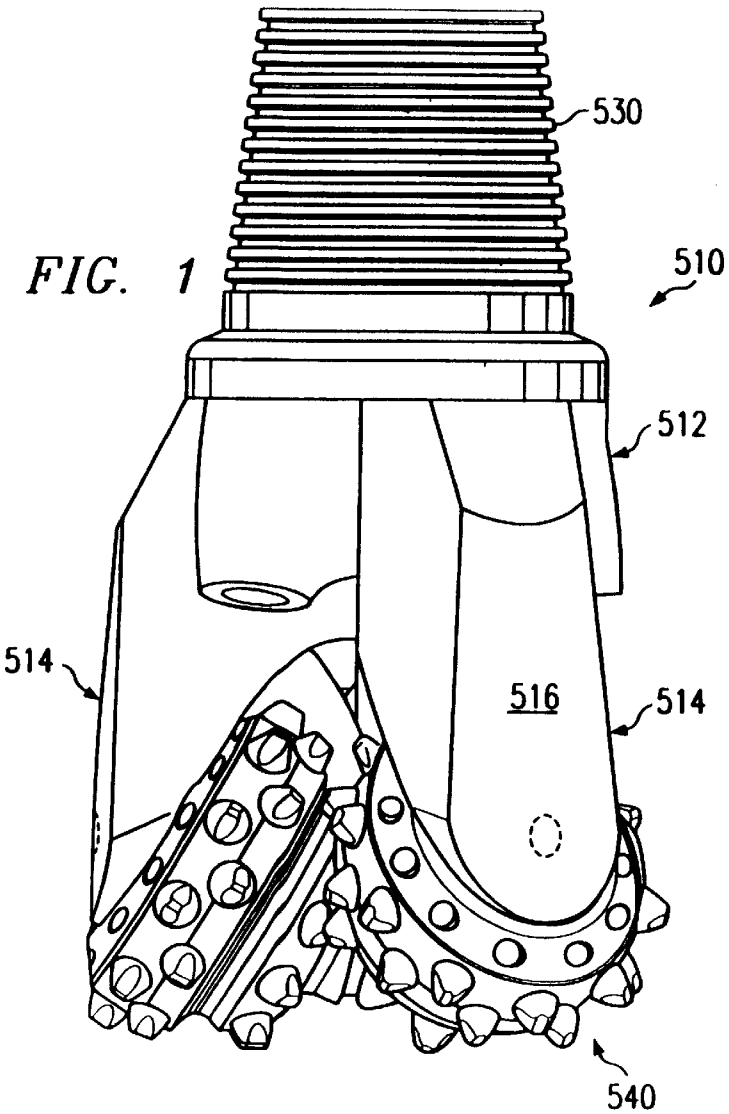
FIG. 1 is a schematic drawing in elevation showing one type of rotary cone drill bit with support arms that may be used in conjunction with cutter cone assemblies formed in accordance with teachings of the present invention.

FIG. 1 illustrates various aspects of a rotary cone drill bit indicated generally at 510 of the type used in drilling a borehole in the earth. Drill bit 510 may also be referred to as a "roller cone rock bit" or "rotary rock bit." With rotary cone drill bit 510, cutting action occurs as cone-shaped cutters, indicated generally at 540, are rolled around the bottom of a borehole (not expressly shown) by the rotation of a drill string (not expressly shown) attached to drill bit 510. Cutter cone assemblies 540 may also be referred to as "rotary cone cutters" or "roller cone cutters." Cutter cone assemblies 540 may be modified so that they may be used in conjunction with the present invention, as described below in conjunction with FIG. 4.

Rotary cone drill bit 510 includes bit body 512 having a tapered, externally threaded upper portion 530 which is adapted to be secured to the lower end of a drill string. Depending from body 512 are three support arms 514. Only two support arms 514 are visible in FIG. 1. Each support arm 514 preferably includes a spindle or journal (not explicitly shown) formed integral with the respective support arm 514. Each cutter cone assembly 540 is rotatably mounted on a respective journal. The journals are preferably angled downwardly and inwardly with respect to bit body 512 and exterior surface 516 of the respective support arm 514. As drill bit 510 is rotated, cutter cone assemblies 540 engage the bottom of the borehole. For some applications, the journals may also be tilted at an angle of zero to three or four degrees in the direction of rotation of drill bit 510.

Figure 2:
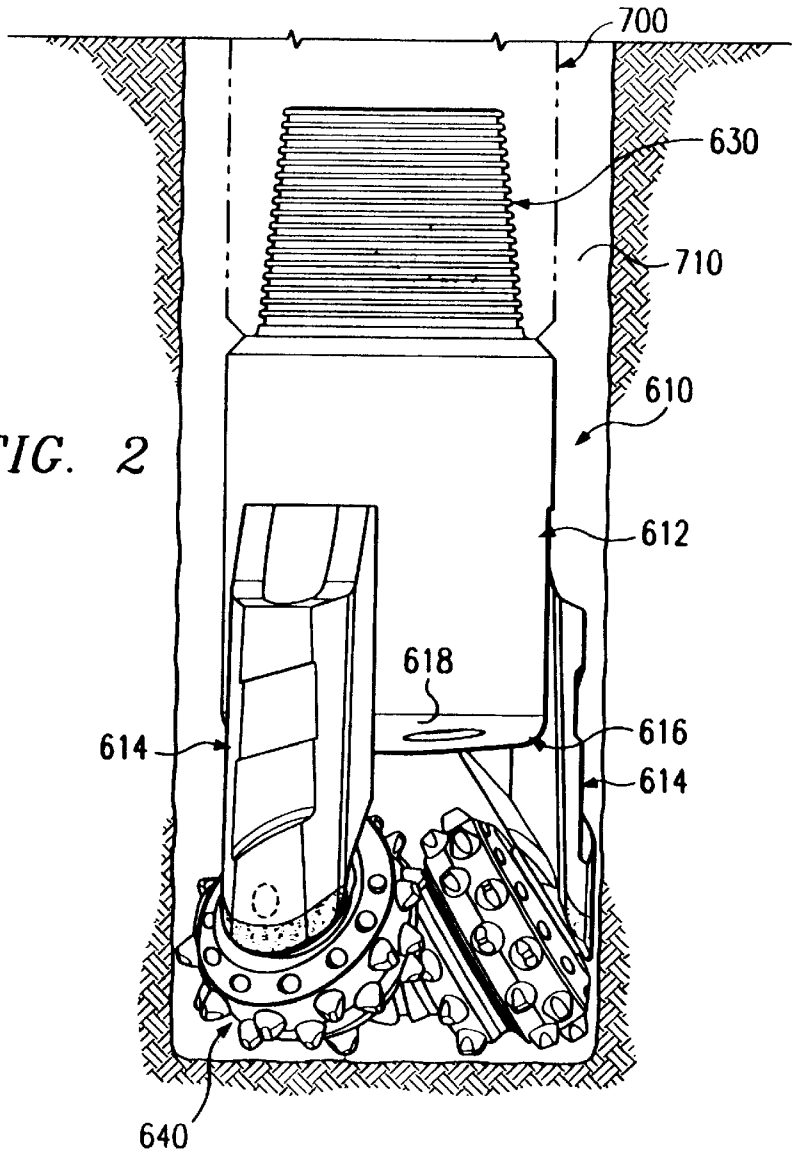
FIG. 2 is a schematic drawing in section and in elevation with portions broken away showing another type of rotary cone drill bit disposed at a downhole location in a borehole with the drill bit having support arms that may be used in conjunction with cutter cone assemblies formed in accordance with teachings of the present invention.

FIG. 2 is an isometric drawing of a rotary cone drill bit indicated generally at 610 attached to drill string 700 and disposed in borehole 710. Examples of such drill bits and their associated bit body, support arms and cutter cone assemblies are shown in U.S. Pat. No. 5,439,067 entitled *Rock Bit With Enhanced Fluid Return Area*, and U.S. Pat. No. 5,439,068 entitled *Modular Rotary Drill Bit*. These patents provide additional information concerning the manufacture and assembly of unitary bit bodies, support arms and cutter cone assemblies which are satisfactory for use with the present invention. Drill bit 610 includes one piece or unitary body 612 with upper portion 630 having a threaded connection adapted to secure drill bit 610 with the lower end of drill string 700. Three support arms 614 are preferably attached to and extend longitudinally from bit body 612 opposite from upper portion 630. Only two support arms 614 are shown in FIG. 2. Each support arm 614 preferably includes a respective cutter cone assembly 640. Cutter cone assemblies 640 extend generally downwardly and inwardly from respective support arms 614. Cutter cone assemblies 640 may be modified so that they may be used in conjunction with the present invention, as described below in conjunction with FIG. 4.

Bit body 612 includes lower portion 616 having a generally convex exterior surface 618 formed thereon. The dimensions of convex surface 618 and the location of cutter cone assemblies 640 are selected to optimize fluid flow between lower portion 616 of bit body 612 and cutter cone assemblies 640. The location of each cutter cone assembly 640 relative to lower portion 616 may be varied by adjusting the length of support arms 614 and the spacing of support arms 614 on the exterior of bit body 612.

Figure 3:
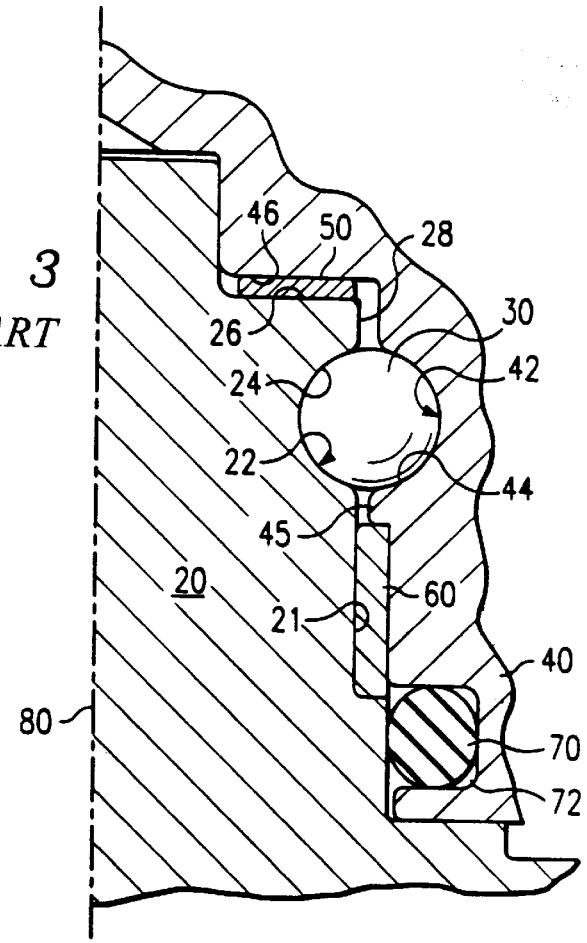
FIG. 3 PRIOR ART
FIG. 3 is a schematic drawing in section with portions broken away showing portions of a typical rotary cone drill bit having a support arm with a journal or spindle extending therefrom, and having a cutter cone assembly rotatably mounted on the journal.

Referring now to FIG. 3, a schematic drawing shows portions of a typical rotary cone drill bit 10 having a support arm with a journal or spindle 20 extending therefrom, and a cutter cone assembly 40 rotatably mounted on the journal 20. Journal 20 fits within a cavity formed in cutter cone 40, and is mounted such that it may rotate about the longitudinal axis 80 of journal 20.

A series of ball bearings 30 are disposed between journal 20 and cutter cone 40 to hold cutter cone 40 onto journal 20, and to facilitate rotation of cutter cone 40 about journal 20. Ball bearings 30 are positioned between an arm ball race 22 formed in journal 20 and a cone ball race 42 formed in cutter cone 40. Arm ball race 22 and cone ball race 42 are both annular grooves. The radius of cone ball race 42 is typically closer to the radius of the ball bearings 30 than is the radius of arm ball race 22. With such a configuration, arm ball race 22 is primarily loaded along a surface 24. Surface 24 is approximately the top half of arm ball race 22, as shown in FIG. 3. Any forces that tend to pull cutter cone 40 off journal 20 are taken up by journal 20 along surface 24.

The portion of journal 20 that extends over ball bearings 30 is a thrust flange 28. Thrust surface 26 of thrust flange 28 aids in bearing the load placed on journal 20 by surface 46 of cutter cone 40. In the prior art, the diameter of thrust flange 28 extends no further than the diameter of a journal bearing surface 21 of journal 20. A thrust washer or bushing 50 may be positioned between thrust surface 26 of thrust flange 28 and surface 46 of cone 40. The outside diameter of thrust washer 50 is typically smaller than or equal to the diameter of thrust flange 28. Alternatively, surface 26 of thrust flange 28 may directly contact surface 46. This is typically referred to as "flange contact." A journal bushing 60 is positioned around journal 20 such that it contacts journal bearing surface 21. Journal bushing 60 functions to absorb some of the forces transmitted between cutter cone 40 and journal 20, and to facilitate the rotation of cutter cone 40 around journal 20. Journal bushing 60 is separated from ball bearings 30 by a bearing flange 45. Drill bit 10 also includes a elastomeric seal 70 to prevent debris from entering the gap between journal 20 and cone 40. Seal 70 is disposed in an annular groove 72 formed in the interior surface of cutter cone 40.

The present invention teaches creating an enhanced journal bushing by increasing the length of journal bushing 60 so that it occupies a larger portion of the gap between cutter cone 40 and journal 20. To facilitate the increased length of journal bushing 60, bearing flange 45 of cutter cone 40 is removed in the present invention. The other features of drill bit 10 of FIG. 3 will remain substantially the same. A portion of a rotary cone drill bit 110 incorporating the teachings of the present invention is shown in FIG. 4.

Figure 4:
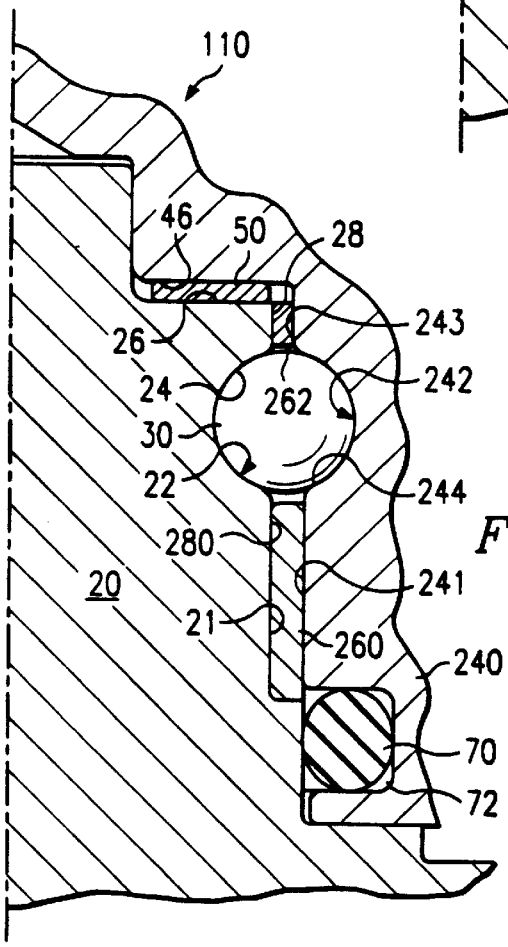
FIG. 4 is a schematic drawing in section with portions broken away of a rotary cone drill bit support arm having a journal or spindle extending therefrom with an enhanced journal bushing disposed between a portion of the outside diameter of the journal and an adjacent portion of the inside diameter of a cutter cone assembly rotatably mounted on the journal.

Referring now to FIG. 4, the removal of the bearing flange results in a journal bearing surface 241 that has a uniform inside diameter from the top of annular groove 72 to cone ball race 242. The length of enhanced journal bushing 260 is greater than the length of journal bushing 60 of FIG. 3, and journal bushing 260 extends so that it is almost in contact with ball bearings 30. By extending journal bushing 260, area 280, which is in contact with the additional length of journal bushing 260, now becomes a load-bearing surface. The increased length of journal bushing 260 improves the performance of drill bit 110. The unit loading on journal bushing 260 is reduced by increasing the total area of contact, which in turn increases the load-bearing capability of journal bushing 260. The increased load-bearing capacity of journal bushing 260 improves the performance of drill bit 110.

As drill bit 110 operates, journal bushing 260 will "float" between cutter cone 240 and journal 20. As it floats, it will be retained by and come in contact with ball bearings 30. The fact that journal bushing 260 is in contact with ball bearings 30, instead of a bearing flange as in FIG. 3, may also act to increase the life of journal bushing 260. Journal bushing may experience reduced wear since it is contacting ball bearings 30 which are rotating or moving, as opposed to a fixed hard surface such as a bearing flange.

Three variables that need to be considered when operating a rotary cone drill bit are the useful life of the drill bit, the load placed on the drill bit, and the speed at which the drill bit is rotated. For drill bit 110 of FIG. 4, there is approximately a ten to twelve percent increase in load-carrying ability due to the enhanced design of journal bushing 260. Due to this increased load carry capacity, drill bit 110 may be rotated at higher speeds and maintain the same useful life as drill bit 10 of FIG. 3 under the same load. Alternatively, if the operating speed is not increased, then drill bit 110 will have a longer useful life than drill bit 10 of FIG. 3 under the same load. Furthermore, if the operating speed is not increased, but the load is increased around ten percent, drill bit 110 will still have approximately the same useful life as drill bit 10 of FIG. 3.

Figure 5:
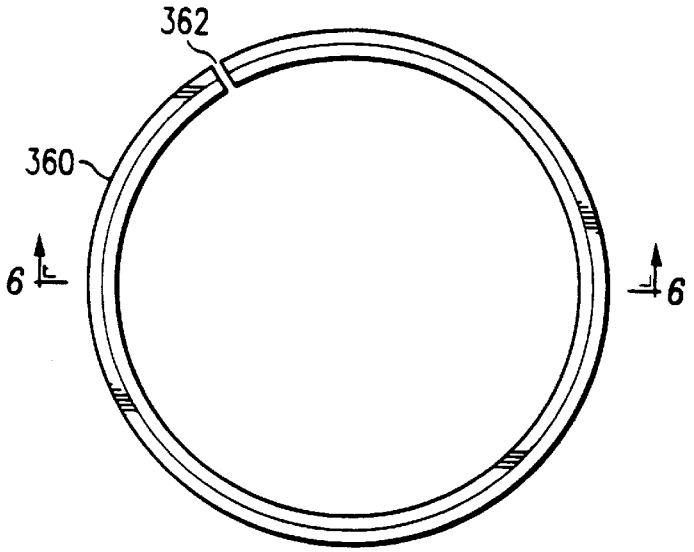
FIG. 5 is a schematic drawing showing a plan view of an enhanced journal bushing which may be satisfactorily used in accordance with teachings of the present invention.
Figure 6:
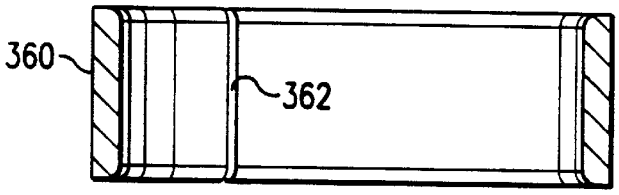
FIG. 6 is a schematic drawing in section taken along lines 6—6 of FIG. 5.

FIG. 5 is a schematic drawing showing a plan view of an enhanced journal bushing 360 which may be satisfactorily used in accordance with teachings of the present invention. FIG. 6 shows a cross-section of journal bushing 360. As can be seen from FIGS. 5 and 6, journal bushing 360 may be split at a point 362. Such a split is made to allow the expansion of journal bushing 360 for placement around a journal. For some applications, however, it may be desirable to have a two-piece journal bushing (not explicitly shown). Such a two-piece journal bushing would include another split located directly opposite the split shown in FIG. 5, thus forming two generally semi-circular halves. Such a two-piece configuration is particularly useful when the journal bushing is made out of material that is not flexible or does not return to its desired shape after being placed around the journal.

Returning now to FIG. 4, in addition to journal bushing 260, there may be a second journal bushing 262 located above ball bearings 30. Second journal bushing 262 is located between thrust flange 28 and a surface 243 of cutter cone 40. The use of second journal bushing 262 allows the edge of thrust flange 28 to be used as a load-bearing surface similar to surface 21. This additional load-bearing surface further reduces the unit loading on the interfaces between journal 20 and cutter cone 240, and thus increases the useful life and load capacity of drill bit 110.

Figure 7:
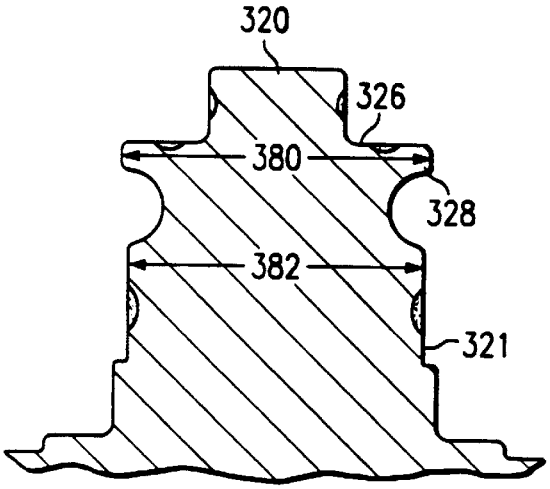
FIG. 7 is a schematic drawing in section with portions broken away of a rotary cone drill bit support arm having a journal extending therefrom with an enhanced thrust flange formed on one end of the journal in accordance with teachings of the present invention.

Referring now to FIG. 7, there is shown a journal 320 that incorporates another aspect of the present invention. This aspect involves forming an enhanced thrust flange 328 by increasing the outer diameter of the thrust flange so that it extends past surface 321. In other words, diameter 380 of thrust flange 328 will be larger than diameter 382 of journal 320. Due to the increased diameter of thrust flange 328, a thrust washer (not explicitly shown in FIG. 7) with an increased diameter may also be utilized. As with the journal bushings described above, the increased size of thrust flange 328 (and thrust washer, if applicable) decreases the unit loading at the interface between surface 326 of thrust flange 328 and surface 346 of cutter cone 340, shown in FIG. 8.

Figure 8:
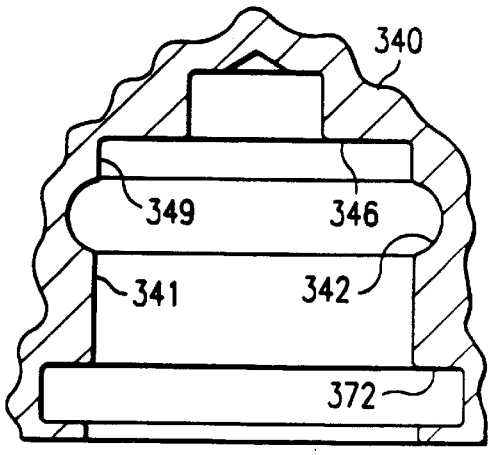
FIG. 8 is a schematic drawing in section with portions broken away showing a cutter cone assembly having an extended inside diameter portion sized to accommodate an enhanced journal bushing disposed between the inside diameter portion of the cutter cone assembly and an adjacent outside diameter portion of the journal when the cutter cone assembly is rotatably mounted on the journal of FIG. 7.

Referring now to FIG. 8, there is shown a cutter cone 340 that may be utilized in conjunction with journal 320 of FIG. 7. Cutter cone 340 includes a surface 341 that can be used in conjunction with an enhanced journal bushing as described in conjunction with FIG. 4. In addition, cutter cone 340 may be used in conjunction with a journal, such as journal 320 of FIG. 7, which incorporates an enhanced thrust flange 328. A second journal bushing (not explicitly shown in FIG. 8), as described above, may also be used in conjunction with cutter cone 340 and journal 320.

Figure 9:
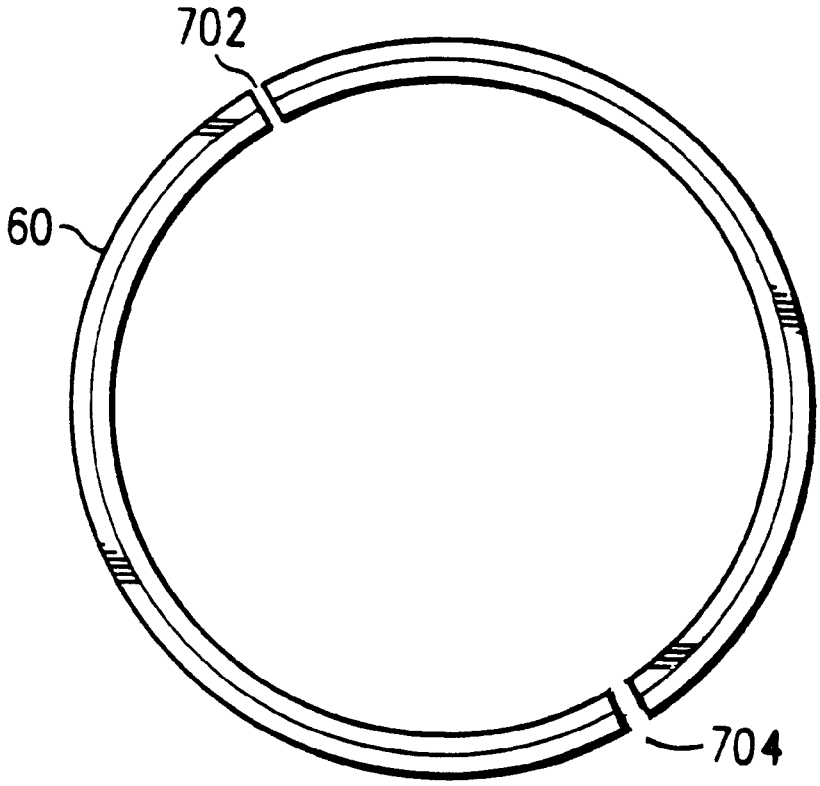
FIG. 9 shows a journal bushing including two splits to aid in placement over the journal.

FIG. 9 is a schematic drawing showing a journal bushing 60. Journal bushing 60 may be split at points 702 and 704. Such splits are made to allow the journal bushing 60 to be easily placed around a journal.

As described above, increasing the size of the interfaces between the various surfaces of a cutter cone and its associated journal will decreases the unit loading on these interfaces. This reduced unit load produces a drill bit that will last longer and/or take higher loads or higher speeds. In addition to decreasing the unit loading, another advantage of having a larger thrust flange, thrust washer, and journal bearing is increased stability. Because the cutter cone is supported by more surface area of the journal, the ability of the cutter cone to rock or wobble on the journal is reduced. By maintaining the cutter cone concentric with the journal, the wear on the journal bushings, the thrust washer, the ball bearings, and the seal is minimized. This substantially increases the downhole life of the drill bit.

Although the present invention has been described by several embodiments, various changes and modifications may be suggested to one skilled in the art. It is intended that the present invention encompasses such changes and modifications as fall within the scope of the present appended claims.

What is claimed is:

1. A rotary cone drill bit, comprising:

a bit body having an upper portion adapted for connection to a drill string;

a journal having a first end operatively attached to said bit body and having a thrust flange near a second end of said journal, which is opposite said first end;

a cutter cone which is rotatably attached to said journal;

a ball race comprising an first annular groove in said journal between said first and said second ends and a second annular groove in said cone adjacent said first annular groove;

a plurality of ball bearings arranged in said ball race;

a first journal bearing surface between said ball race and said first end of said journal;

a second journal bearing surface between said ball race and said rust flange;

a first bushing which floats between said journal and said cone at said first journal bearing surface; and second bushing which floats between said journal and said cone at said second journal bearing surface.

2. The rotary cone drill bit of claim 1 further comprising an elastomeric seal positioned between said cone and said journal adjacent said first end of said journal, whereby said elastomeric seal prevents debris from entering said bearings.

3. The rotary cone drill bit of claim 1 further comprising a support arm through which said journal is attached to said body of said drill bit.

4. The rotary cone drill bit of claim 1 wherein said journal projects generally downwardly and inwardly with respect to the axis of rotation for the bit.

5. A support arm cutter assembly for a rotary cone drill bit, comprising:

a support arm having an inside surface;

a journal having a first end operatively attached to said support arm and having a thrust flange near a second end of said journal which is opposite said first end;

a cutter cone which is rotatably attached to said journal;

a ball race comprising an first annular groove in said journal between said first and said second ends and a second annular groove in said cone adjacent said first annular groove;

a plurality of ball bearings arranged in said ball race;

a first journal bearing surface between said ball race and said first end of said journal;

a second journal bearing surface between said ball race and said thrust flange;

a first bushing which floats between said journal and said cone at said first journal bearing surface; and a second bushing which floats between said journal and said cone at said second journal bearing surface.

6. The support arm cutter assembly of claim 5, further comprising an elastomeric seal positioned between said cone and said journal adjacent said first end of said journal, whereby said elastomeric seal prevents debris from entering said bearings.

7. A rotary cone drill bit, comprising:

a body having an end adapted for connection to a drill string;

a spindle which is operatively attached to said body at a first end and which has a thrust flange near a second end of said spindle which is opposite said first end; and a cone which rotates around said spindle at a bearing;

wherein said bearing comprises:

a first journal bearing portion at said first end of said spindle;

a second journal bearing portion between said first journal bearing portion and said thrust flange;

a retention mechanism which separates said first and said second journal bearing portions;

a first bushing which floats between said spindle and said cone at said first journal bearing portion; and a second bushing which floats between said spindle and said cone at said second journal bearing portion.

8. The rotary cone drill bit of claim 7, wherein said retention portion comprises ball bearings.

9. The rotary cone drill bit of claim 7, further comprising an elastomeric seal positioned between said cone and said journal at said first end of said journal, whereby said elastomeric seal prevents debris from entering said bearings.

10. The rotary cone drill bit of claim 7, further comprising a support arm through which said spindle is attached to said body of said drill bit.

* * * * *